US006579108B1

(12) United States Patent
Goff

(10) Patent No.: US 6,579,108 B1
(45) Date of Patent: Jun. 17, 2003

(54) RETRACTABLE JACK

(75) Inventor: Darrell Goff, Highland, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/981,201

(22) Filed: Oct. 17, 2001

(51) Int. Cl.[7] ..... H01R 13/60

(52) U.S. Cl. ..... 439/131; 439/144; 439/159; 439/946

(58) Field of Search ..... 439/131, 144, 439/676, 159, 946, 344

(56) References Cited

U.S. PATENT DOCUMENTS 5,183,404 A 2/1993 Aldous et al. ..... 439/55
5,547,401 A 8/1996 Aldous et al. ..... 439/676
5,928,009 A * 7/1999 Lee ..... 439/131
6,099,329 A 8/2000 Goff et al. ..... 439/131
6,167,781 B1 * 1/2001 Madsen et al. ..... 74/569
6,375,479 B1 * 4/2002 Johnson et al. ..... 439/131

* cited by examiner

*Primary Examiner*—Tho D. Ta
*Assistant Examiner*—James R. Harvey
(74) *Attorney, Agent, or Firm*—Workman, Nydegger & Seeley

(57) ABSTRACT

A retractable connector (44) includes a base (82) slidably positioned within an electronic card (42). The connector further includes an elongated channel (104) which provides the tracking of the base member between an extended position and a retracted position along an axis. The elongated channel (104) is comprised of a retraction profile (160) for maintaining the base member having the connector thereon in a retracted position and an extension profile (162) for maintaining the base member in an extended position. The extension profile within the channel includes sides or facets including guide posts that facilitate the stopping of the base member from entering into a retracted position when axial forces are initially applied such as during the mating of an external connector with retractable connector of the electronic card.

20 Claims, 7 Drawing Sheets

RETRACTABLE JACK

BACKGROUND OF THE INVENTION

1. The Field of the Invention

The present invention relates to the field of computers. More particularly, it relates to a retractable interface between a connector and an electronic device such as a computer.

2. The Present State of the Art

Smaller and more portable computers (often referred to as laptop or notebook computers) have taken the place of many desktop or stand-alone models. With the new-found portability of laptop or notebook computers, the size of external modules or peripherals have also become modular. Furthermore, to overcome the inconvenience and the physical limitations of external modules, smaller more integrated modules have been developed that are capable of being housed within a portable computer. Such a module is illustrated in FIG. 1 as module 10 which is capable of being housed within portable computer 12.

In order to interface with networks or other interactive components, sockets or plugs have populated exposed facets of module 10. In FIG. 1, a socket 14 is illustrated as being formed within the housing of module 10. The socket as depicted in FIG. 1, is capable of receiving, for example, an RJ-xx connector 16 which may be coupled to various network or communication topologies.

Various other types of couplers have been developed for electrically connecting with higher bandwidth interfaces. FIG. 1 depicts coaxial plug 18 as being housed on an exposed facet of module 10. Although coaxial cable has been developed in various designs, each coaxial cable includes a center conductor over which a signal is transferred. A flexible tubular insulator made of a dielectric or non-conductive material encircles the conductor. In turn, a flexible conductive sleeve often in a form of wire mesh encircles the insulator. The conductive sleeve functions as a shield or ground to help maintain the integrity of the signal in the center conductive cable. Finally, the conductive sleeve is coated with a durable insulative sheet.

Coaxial cables are well integrated and used extensively in many network systems throughout the world. One of the benefits of coaxial cable is its simple and standardized couplers for connecting with electrical apparatus. The coupler includes the coaxial connector, with one such example being typically known as a BNC, which is connected with a corresponding jack. A conventional coaxial connector has a relatively large tubular structure, while the jack includes a tubular plug, which interlocks with the connector by a type of threaded engagement or be a press-fit friction engagement.

One of the drawbacks in using coaxial cable is that many of the standardized coaxial jacks have a relatively large diameter that is greater than the thickness of most modules such as PC cards. FIG. 2 depicts one prior attempt at addressing the complication of interfacing a relatively larger coaxial connector with a reduced-sized card 22. In FIG. 2, a module or PC card 20 is depicted as having a reduced size electronic portion with an enlarged interface portion 24 for the attachment of the much larger coaxial jack 26. However, such an appendage to a traditional PC card is very undesirable as it protrudes and distracts from the generalized form factor of the personal computer not only during operation but also during storage and non-use. Such a protuberance is undesirable and distracting from the overall modularity and desirability of a module for interfacing with a portable computer.

BRIEF SUMMARY OF THE INVENTION

A connector to facilitate the coupling of an external jack having a longitudinal attachment with a retractable connector including a stop for preventing initial retraction during the attachment of the external connector is provided. Modular electronic cards have dictated the miniaturization of connection mechanisms and, as such, many mechanisms are now manifesting themselves as retractable connectors. The present invention includes an electronic card having a housing with a circuit board disposed therein and a slidable connector assembly coupled therewith. A slidable connector assembly is configured to slidably alternate between a retracted position and an extended position wherein coupling of an external connector is feasible.

The slidable connector further includes a base member about which the electronic card connector is mounted. In the preferred embodiment, the base member slides about a rail located within the housing and is movable between a retracted position and an extended position. The base member tracks or maneuvers between the extended and retracted position according to an elongated channel disposed within the base member. The elongated channel includes a retraction profile portion for maintaining the base member having the connector thereon in a retracted position and an extension profile portion for maintaining the base member having the connector therein in an extended position. These profiles are comprised of various grooves and surfaces including sides of the channel and other guide posts that facilitate the latching and the stopping of the base member of the connector.

The retraction profile assumes a configuration for maintaining the base member in the retracted position once force has been applied to the base member. The retraction profile also releases the base member from the retracted position when subsequent force is applied to the base member.

The extension profile maintains the base member in an extended position thereby allowing the user to couple an external connector with the connector of the electronic card. The present invention facilitates the axial placement of a connector on the base member with reference to the extension-retraction axis of the retractable or base member. Axial attachment of external connectors is accommodated in the present invention by the extension profile which, when initially subjected to the coupling force that would otherwise cause the base member to commence retraction, maintains a stop which prevents the connector from retracting during the mating or coupling of the external connector with the connector of the electronic card. Subsequent to attachment of the external connector, the base member having the connector thereon resorts to a second resting extended position. Upon the removal of the external connector, subsequent retraction force about the retractable connector facilitates the retraction and retention of the retractable connector, and more particularly the base member, within the electronic card.

The preferred embodiment of the present invention teaches the retractable connector of assuming a coaxial connector configuration. An alternate embodiment facilitates the attachment of any axially oriented connectors including end-mounted modular jacks.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
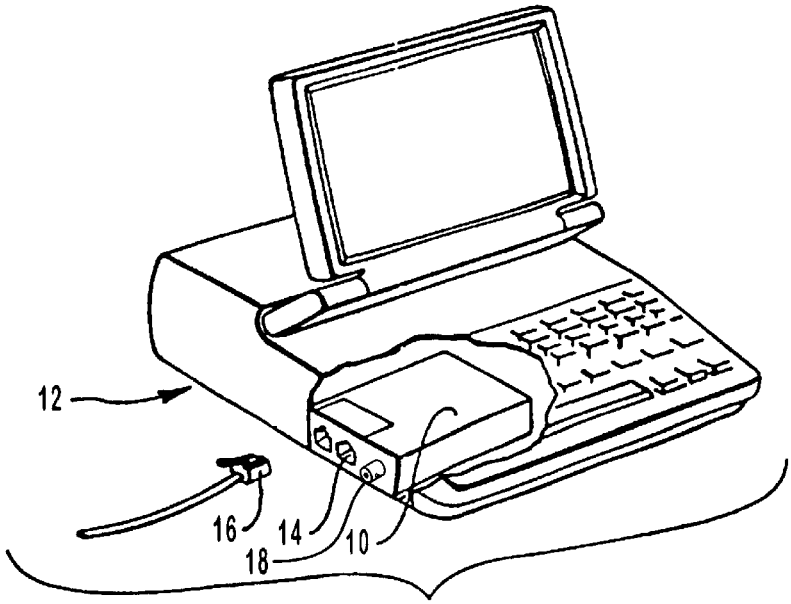
FIG. 1 (PRIOR ART)
FIG. 1 is a perspective view of a computer having a PC card with a large form factor sufficient for attachment of a coaxial connector directly thereon, in accordance with the prior art.
Figure 2:
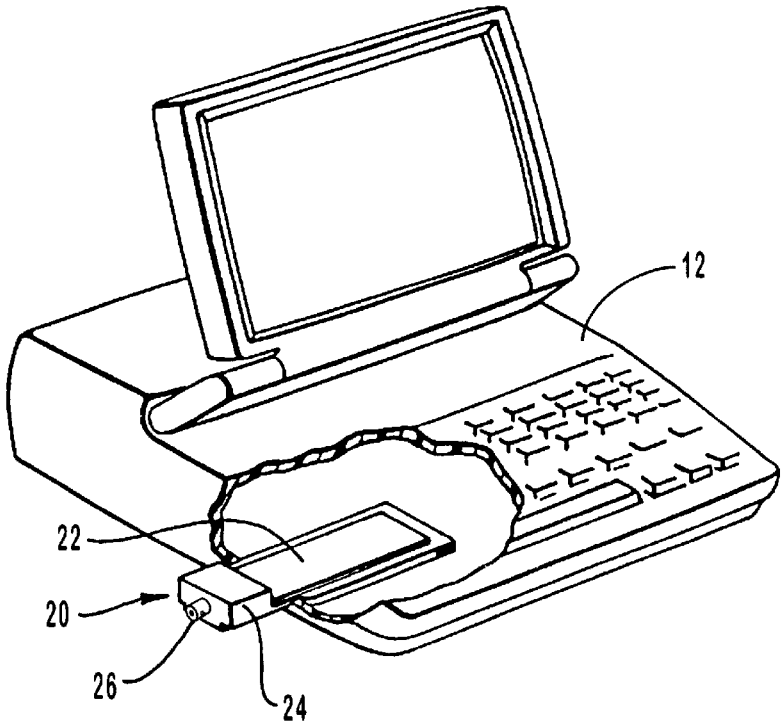
FIG. 2 (PRIOR ART)
FIG. 2 is a perspective view of a computer having a reduced-sized PC card with an enlarged external connector interface for directly coupling a coaxial jack thereto, in accordance with the prior art.
Figure 3:
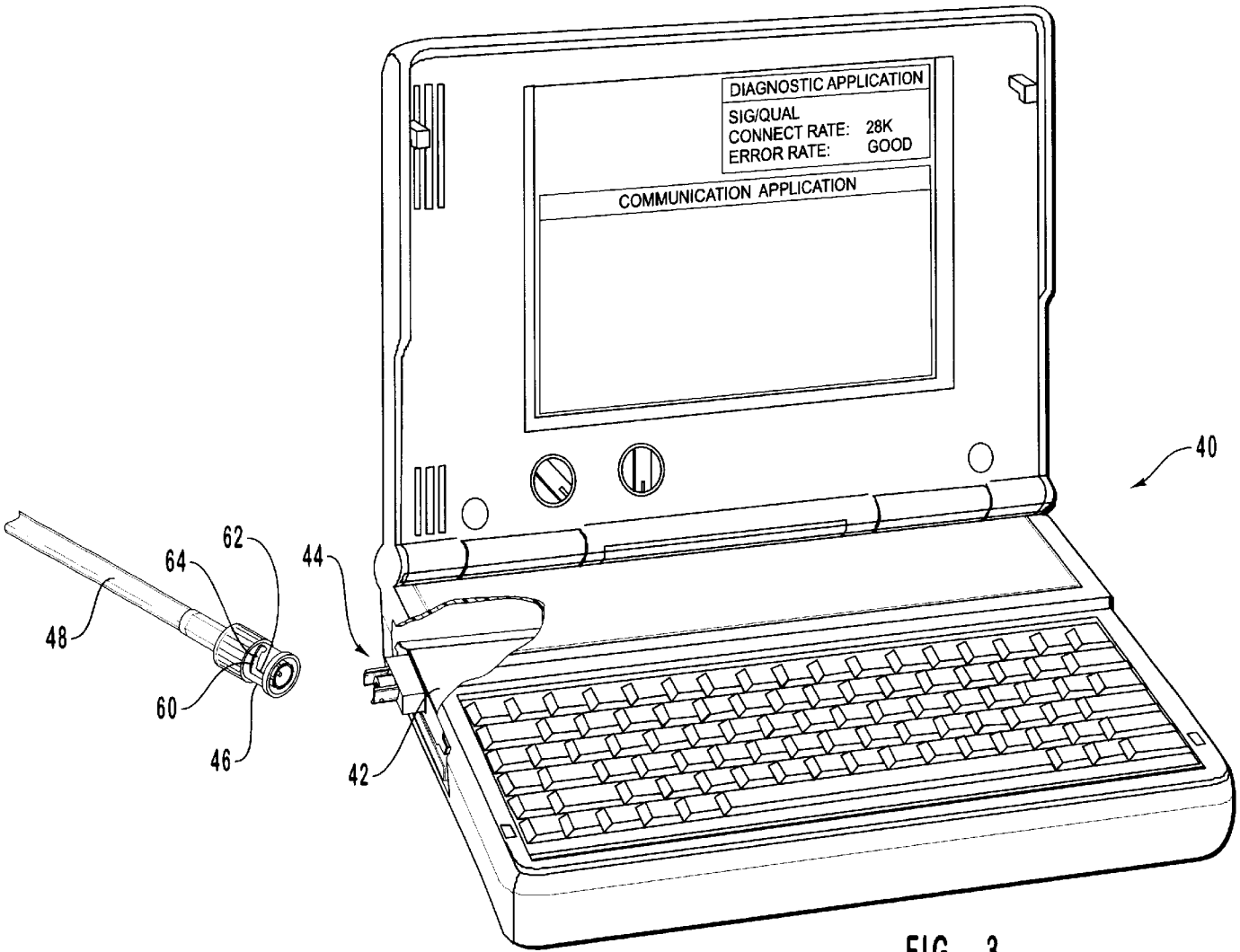
FIG. 3 (PRIOR ART)
FIG. 3 is a perspective view of a computer having a PC card with a reduced-sized connector interface, consistent with the dimensions of the reduced-sized PC card, in accordance with a preferred embodiment of the present invention.

FIG. 3 depicts a computer 40 housing a PC card 42. The term "PC card," as used in the specification and appended claims, is broadly intended to include the various types of cards falling within the Personal Computer Memory Card International Association (PCMCA) perimeters, communication cards falling outside of those standard, and cards which are developed under new standards. Examples of PC cards include modem cards, network cards, memory cards, SCSI cards, cellular phone cards, and combination thereof. PC cards can have but are not limited to having Type I, II, or III form factors.

A retractable coaxial jack 44, in a preferred embodiment of the present invention, is attached to the PC card 42. The coaxial jack 44 is configured to be physically and electrically coupled to a coaxial connector 46 attached to an end of a coaxial cable 48. As used in the specification and appended claims, the term "coaxial connector" is broadly intended to include all the various types of connectors used with coaxial cables. One example of a coaxial connector, as depicted in FIG. 3, is a bayonet connector or BNC. Other types of coaxial connectors include RCA connectors and F-type connectors. Coaxial connector 46 is mounted on a coaxial cable 48 but could equally be mounted on other conventional adapters designed for operation with a coaxial cable. For additional disclosure, U.S. Pat. No. 6,099,329, filed Oct. 30, 1998 is incorporated herein by specific reference.

Figure 4:
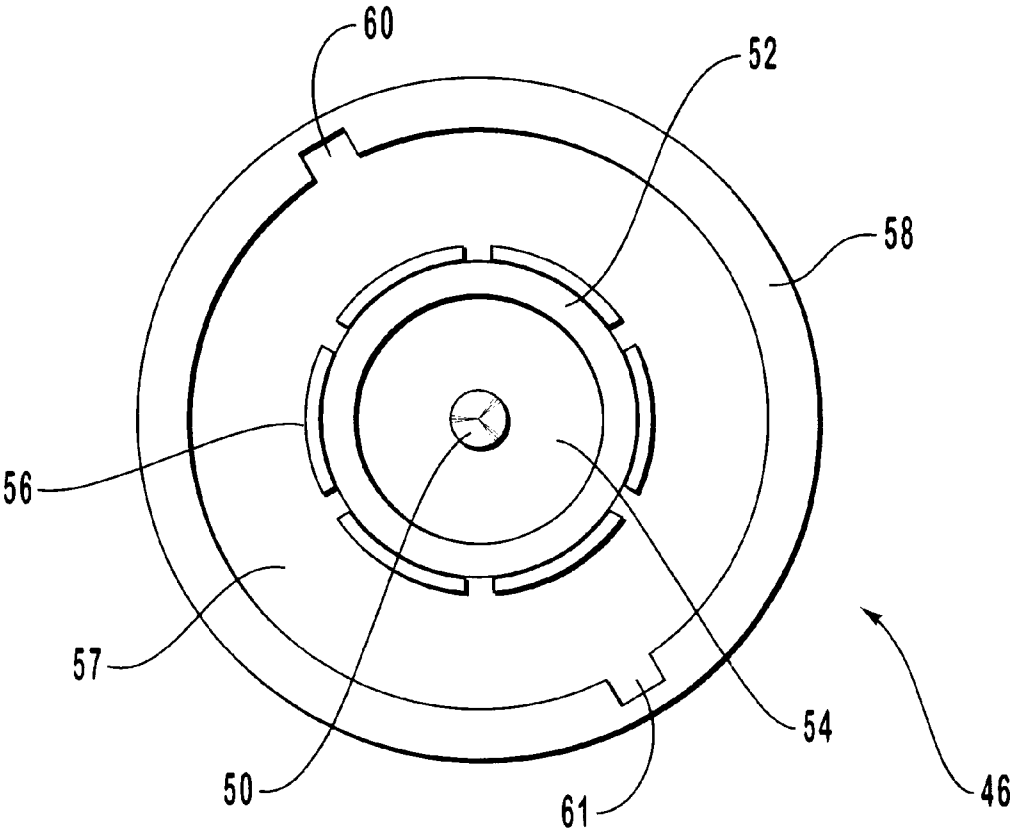
FIG. 4 (PRIOR ART)
FIG. 4 is front view of a coaxial connector shown in FIG. 3.

As depicted in FIGS. 3 and 4, coaxial connector 46 comprises a tubular insulator 52 bounding a substantially cylindrical chamber 54. Concentrically disposed within chamber 54 is a metal contact pin or conductor 50. Encircling the exterior of insulator 52 is a conductive sleeve 56. Rotatably encircling sleeve 56 is an annular collar 58. Conductive sleeve 56 and collar 58 bound an annular space 57 therebetween. Formed on opposing sides of collar 58 are a pair of slots 60 and 61. As depicted in FIG. 3, each slot 60 and 61 includes a first section 62 that is axially aligned with coaxial connector 46 and a second section 64 that curves to partially spiral around coaxial connector 46.

Figure 5:
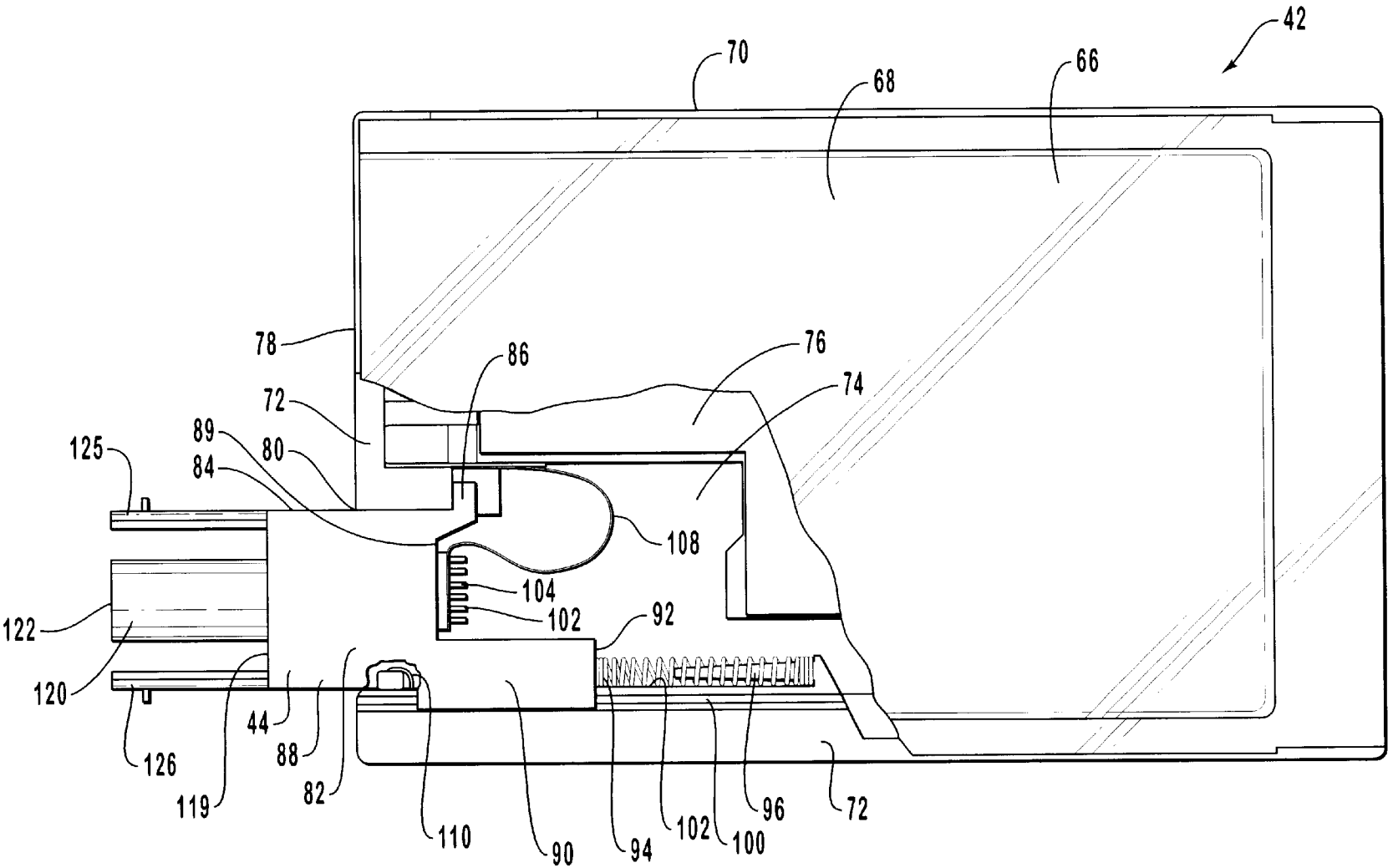
FIG. 5 (PRIOR ART)
FIG. 5 is a partially cut-a-way top view of the PC card shown in FIG. 3 with the inventive extendable jack and retention mechanism, in accordance with a preferred embodiment of the present invention.

FIG. 5 depicts a PC card 42 comprising a housing 66 which includes a top cover plate 68 and an opposing bottom cover plate 70. A narrow boarder member 72 secures plates 68 and 70 together around the perimeter thereof. Cover plates 68 and 70 bound a compartment 74 therebetween in which a circuit board 76 is disposed. Formed at a front end 78 of PC card 42 is an opening 80. Opening 80 extends through boarder member 72 to communicate with compartment 74. Coaxial jack 44 is slidably positioned within compartment 74 so as to selectively move between an extended position and a retracted position. In the extended position, as shown in FIG. 5, a portion of coaxial jack 44 projects out of opening 80 for attachment with coaxial connector 46. When not in use, coaxial jack 44 can be selectively moved into the retracted position wherein coaxial jack 44 is substantially enclosed within compartment 74.

Figure 6:
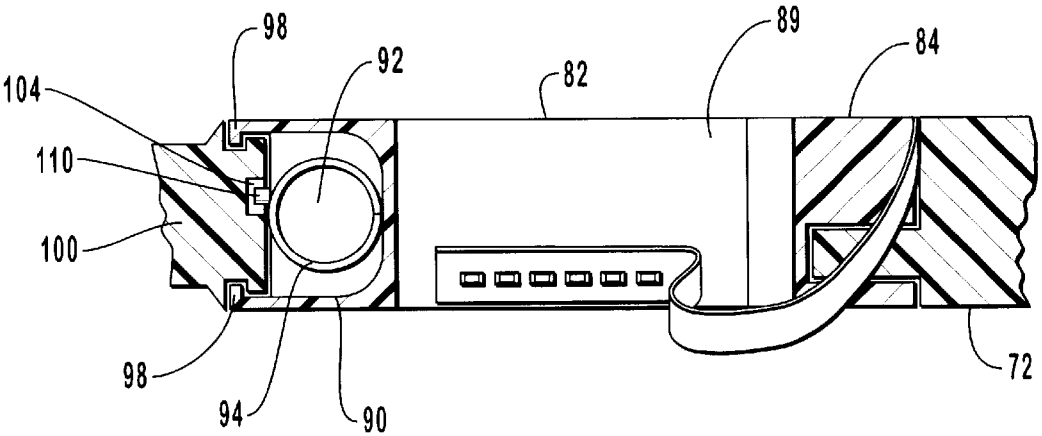
FIG. 6 (PRIOR ART)
FIG. 6 is an elevated partially cross-sectional back view of the extendable connector depicted as a coaxial jack, in accordance with the preferred embodiment of the present invention.
Figure 7:
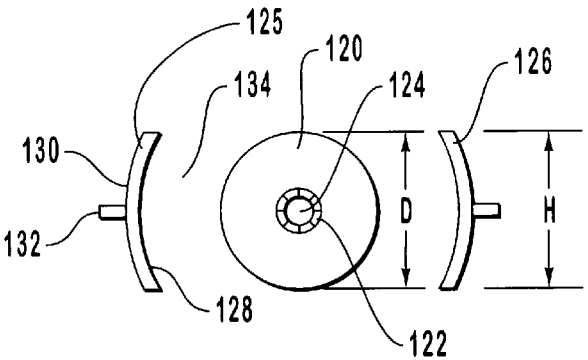
FIG. 7 (PRIOR ART)
FIG. 7 is an elevated front view of the coaxial jack shown in FIG. 5.

As depicted in FIGS. 5 and 6, the coaxial jack 44 comprises a base 82 having opposing sides 84 and 88 extending between a front face 119 and an opposing back face 89. The side 84 of the coaxial jack 44 slidably engages with a portion of the boarder member 72 and a stop 86 outward into the extended position. By way of example, tubular tail 90 projects from the end of side 88. As depicted in FIGS. 5 and 6, tail 90 has an opening 92 configured to receive a spring 94. Tail 90 also includes a pair of inwardly facing finger 98 that slidably engage a rail 100 formed on boarder member 72. The opposing end of spring 94 is mounted on a post 96 projecting off of boarder member 72. In this configuration, spring 94 functions to bias base 82 outward into the extended position.

In alternative embodiments, it is envisioned that spring 94 can be placed at different locations to bias against base 82. Furthermore, spring 94 can be replaced with other conventional types of springs such as a leaf spring. Examples of alternative embodiments of the means for biasing base 82 outward are disclosed in U.S. Pat. No. 5,547,401, filed Aug. 16, 1994 (hereinafter "the '401 patent"), and U.S. patent application Ser. No. 09/357,017, filed Jul. 19, 1999, which are incorporated herein by specific reference.

The present invention also includes means projecting from base 52 for physically and electrically coupling with coaxial connector 46 when base 82 is in the extended position. By way of example and not by limitation, as depicted in FIGS. 3 and 6, projecting from a front face 89 of base 82 is a tubular insulator 120 made from a dielectric material. Insulator 120 encircles a conductive socket 122. Socket 122 bounds an opening 124 configured to receive contact pin 50 (FIG. 4) of coaxial connector 46 in electrical contact. Also projecting from face 119 on opposing sides of insulator 120 is a conductive first retention arm 125 and a conductive second arm 126. In an alternative embodiment, only one of retention arms 125 and 126 needs to be conductive. Each retention arm 125 and 126 has a curved inside face 128 and an opposing curved outside face 130. Each outside face 130 has a knob 132 projecting therefrom. Retention arms 125 and 126 are spaced from tubular insulator 130 so that a gap 134 is formed therebetween. Furthermore, each of retention arms 125 and 126 have a height H which is one embodiment does not exceed the thickness of PC card 12 and more preferably does not exceed the thickness of base 82.

Figure 8:
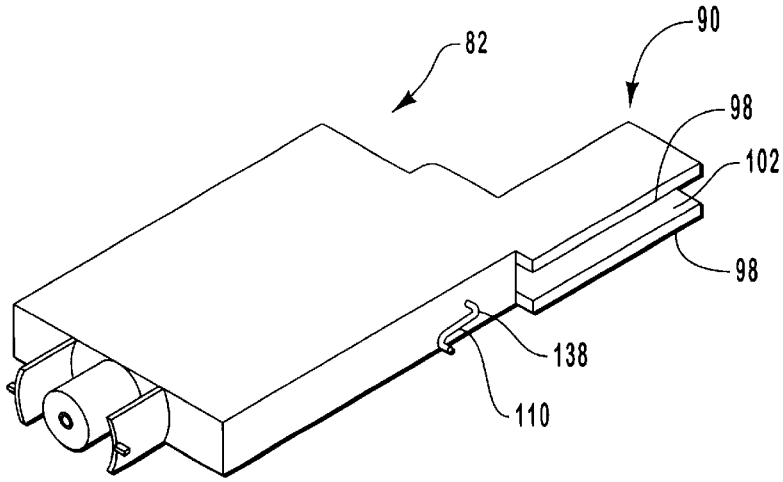
FIG. 8 is a perspective view of a base member portion of the extendable media connector and the associated extension retention mechanism attached thereto, in accordance with the preferred embodiment of the present invention.

FIG. 8 depicts the retractable portion or base member 82 of the retractable coaxial jack 44. This perspective view of base 82 details a latching mechanism for selectively retaining base 82 in a retracted position and furthermore for providing longitudinal resistance for the ease of attaching coaxial connectors or other longitudinally attached connectors when base 82 is an extended position. Flexible pin 110 is attached to base 82 at a flexible pin axis 138 which allows flexible pin 110 to track or operate as a cam follower in an opposing groove exhibiting a varying profile as described in detail below. Base 82 further comprises guide fingers 98 about a base channel 102 which provide a slidable retention capability about rail 100 (FIG. 5) of the fixed portion 136 (FIG. 5) of PC card 42 (FIG. 5).

Figure 9:
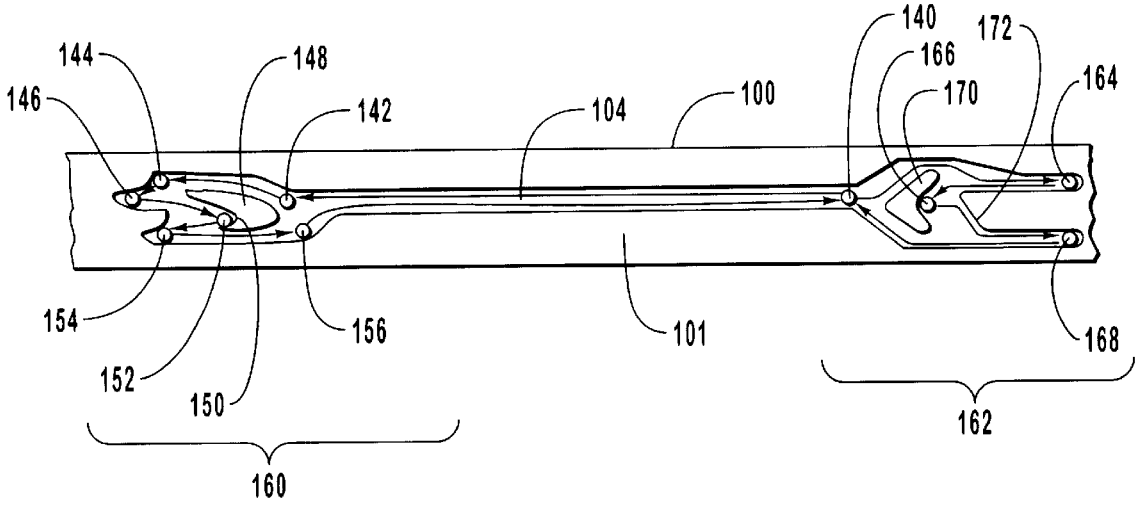
FIG. 9 is a detailed view of an elongated channel defining the travel path and operational aspects of the extendable-retractable media connector, in accordance with the preferred embodiment of the present invention.

FIG. 9 depicts the complimentary portion of the means for selectively retaining base 82 in a retracted position and for providing connector-mating resistance or a connector-attachment retraction stop when base 82 is in an extended position, in accordance with the preferred embodiment of the present invention. By way of example and not limitation, a rail 100 has a front face 101 with a channel 104 recessed therein. Throughout FIG. 9, flexible pin 110 (FIG. 8) is depicted in motion and at certain positions, 140, 142, 144, 146, 152, 154, 156, 164, 166, and 168.

Channel 104 is depicted as generally elongated and disposed within base member 82 (FIG. 8) with the elongated channel being preferably partitioned, for clarity, into a retraction profile 160 and an extension profile 162. It should be pointed out that such a partition is merely illustrative and the spatial relationships between the location of retraction profile 160 and extension profile 162 are function of the size and configuration of base 82 and the depth of a receiving compartment within the housing.

Retraction profile 160 operates for maintaining the base member in a retracted position. Referring to FIG. 9, for illustrative purposes, flexible pin 110 is depicted as starting in a location, for example, position 140 and with the base member 82 attached to flexible pin 110 travels during retraction to a position 142 whereupon flexible pin 110 encounters a retraction guide 148 located generally within the retraction profile and, in the preferred embodiment, integral with rail 100 and exhibiting a profile above the recessed profile of channel 104. Retraction guide 148 redirects the course of flexible pin 110 through one or more sides associated with retraction guide 148 into a position 144 whereupon flexible pin 110 encounters one or more sides associated with rail 100 on front face 101 forming channel 104. Such an encounter at position 144 further redirects flexible pin 110 into a stop position 146. Upon the removal of the retraction force translated to flexible pin 110, a rebound force preferably communicated from spring 94 (FIG. 5) redirects flexible pin 110 to encounter one or more additional sides of retraction guide 148 which, upon the removal of any forces incurred in the retraction direction, causes flexible pin 110 to be retained by retraction guide 148 in an alcove 150 in a position 152.

Flexible pin 110 remains in position 152 until subsequent retraction forces are applied to base 82 (FIG. 8) which are conveyed to flexible pin 110. Flexible pin thereafter encounters one or more sides of rail 100 forming channel 104 to cause a further redirection of flexible pin 110 into a position 154. When compressive forces are again removed from base 82, flexible pin 110 moves from a position 154 into a position 156 thereafter encountering one or more sides of rail 100 forming channel 104 and passes through channel 104 to the extension profile 162 portion of channel 104.

Extension profile 162 maintains the base member 82 (FIG. 8) in an extended position permitting the connector to be functionally accessible by a user and provides a stopping mechanism which prevents the initial retraction of the base member when opposing connector coupling forces are applied during mating of an opposing connector with the connector on base 82. When entering the extended state, flexible pin 110 passes to a position 140 due to the forces exerted by spring 94 (FIG. 5) on base 82 (FIG. 8). Flexible pin 110, when passing to the extended state, encounters one or more sides of an extension guide 170 which redirects the position of flexible pin 110 to alternatively encounter one or more additional sides of channel 104 before coming to rest in a first resting extended position 164. At position 164, the base member 82 assumes a resting extended position. A user coupling a connector with the jack or connector associated with base 82, such as retractable coaxial jack 44 (FIG. 3), exerts retractive force upon flexible pin 110 causing it to move from position 164 to encounter one or more sides of extension guide 170 before coming to rest at a position 166 which invokes a back force or stop to the connector and opposes the forces associated with the coupling of a connector with the jack or other connector associated with base 82. Once such coupling forces are removed, the spring or biasing means associated with the present invention causes flexible pin 110 to encounter one or more sides of channel 104, specifically depicted as sides 172 which causes redirection of flexible pin 110 into a second resting, extended position 168. Once the connector 46 (FIG. 3) is removed from the connector 44 (FIG. 3) associated with base 82, a user may apply a retractive force to base member 82 causing flexible pin 110 to pass from a position 168 to a position 140 through the encountering of one or more sides of channel 104. The process may then be repeated.

Figure 10:
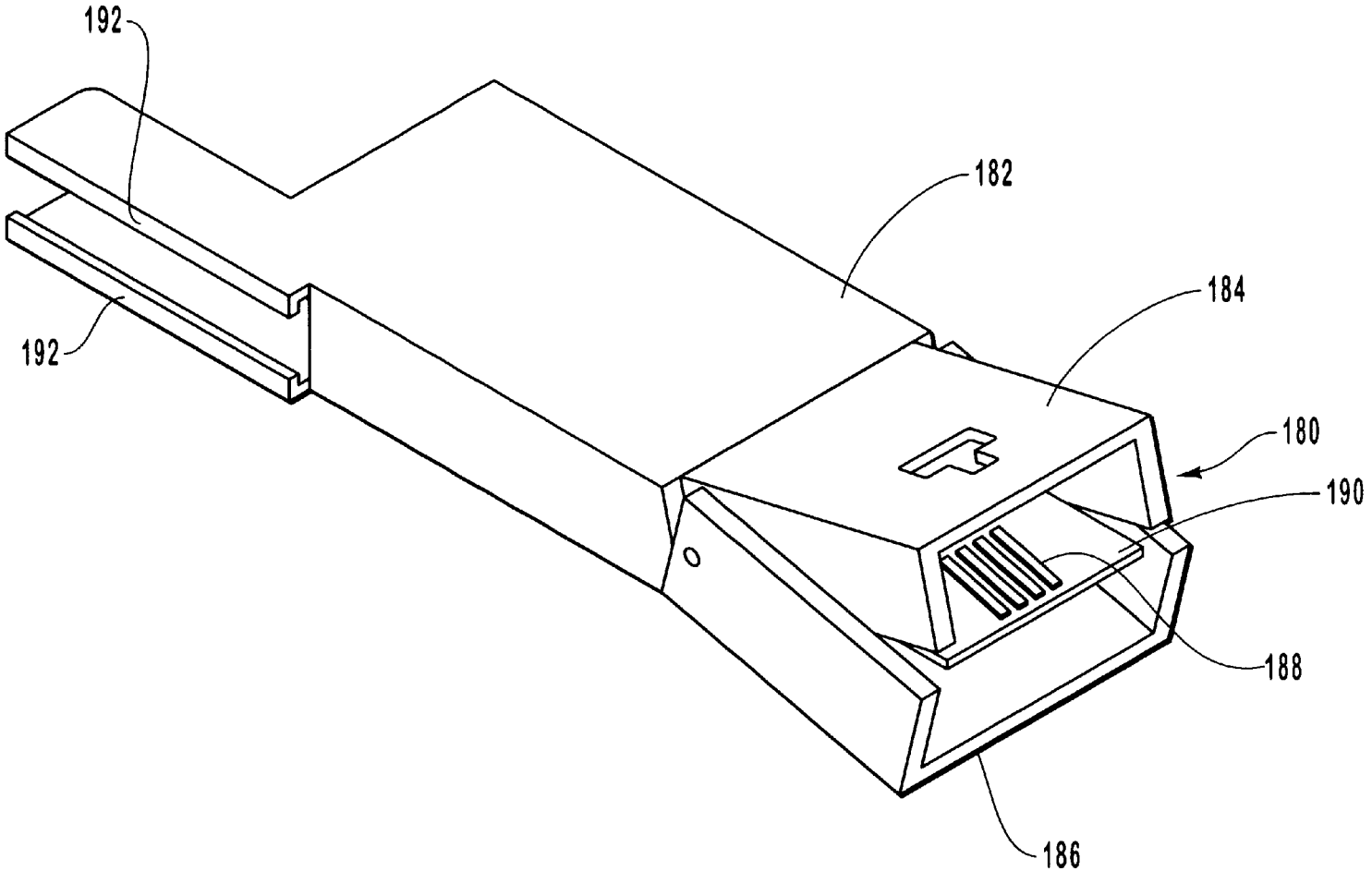
FIG. 10 is a perspective view of a a media connector interface, in accordance with an alternate embodiment of the present invention.

The previous figures have depicted a preferred embodiment of a retractable apparatus that accommodate coaxial connectors. FIG. 10 depicts an alternate embodiment wherein another longitudinal connector attachment is also contemplated. In FIG. 10, a base 182 couples to a connector 180 which forms a longitudinal coupling with an external connector via connector sides 184 and 186 and is electrically coupled via contacts 190. Base 182 couples to rail 100 (FIG. 5) via guide fingers 192 in the manner similarly described above. It is also contemplated that the present invention finds application to connectors that, when coupled together, exert a force on the retracting portion that would frustrate the mating of the connectors together.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for maneuvering a connector in an electronic device between a retracted position and an extended position, said apparatus comprising:

a) a base member having said connector thereon, said base member movable between an extended position and a retracted position along an axis;

b) an elongated channel disposed within said base member, said elongated channel including:

i) a retraction profile for maintaining said base member in said retracted position; and ii) an extension profile for maintaining said base member in said extended position, said extension profile sustaining opposing force from attachment of an opposing connector to said connector on said base member; and c) a flexible pin operably coupled to said electronic device for trackingly engaging said base member according to said elongated channel between said retraction profile and said extension profile.

2. The apparatus as recited in claim 1, wherein said connector is a coaxial plug for receiving a coaxial connector as said opposing connector.

3. The apparatus as recited in claim 1, wherein said base member further comprises a retraction guide within said retraction profile for maintaining said base member in said retracted position, said retraction guide including one or more sides that are adapted to receiving and retaining said flexible pin to maintain said base member in said retracted position.

4. The apparatus as recited in claim 3, wherein said retraction profile includes:

a) one or more sides for guiding said flexible pin to engage with said one or more sides of said retraction guide in said retracted position; and b) one or more sides for guiding said flexible pin from said retraction guide to allow said base member to traverse from said retracted position to said extended position as said flexible pin traverses from said retraction profile to said extension profile.

5. The apparatus as recited in claim 1, further comprising a spring for coupling between said base member and said electronic device and biased to extend said base member from said retracted position to said extended position.

6. The apparatus as recited in claim 1, wherein said base member further comprises an extension guide within said extension profile for maintaining said base member in said extended position, said extension guide including one or more sides that are adapted to block said flexible pin from initially passing from said extended position during coupling of an opposing connector with said connector of said base member.

7. The apparatus as recited in claim 6, wherein said extension profile includes:

a) one or more sides for guiding said flexible pin to engage with said one or more sides of said extension guide in said extended position; and b) one or more sides for guiding said flexible pin from alignment with said extension guide to allow said base member to traverse from said extended position to said retracted position as said flexible pin traverses from said extension profile to said retraction profile.

8. A coaxial jack for connecting a coaxial cable to an electronic card, comprising:

a) a base member movable between an extended position and a retracted position along an axis;

b) a coaxial connector physically coupled to said base member and electrically coupled to said electronic card;

c) an elongated channel disposed within said base member, said elongated channel including:

i) a retraction profile for maintaining said base member in said retracted position; and ii) an extension profile for maintaining said base member in said extended position, said extension profile sustaining opposing force from attachment of a coaxial connector to said coaxial jack on said base member; and d) a flexible pin operably coupled to said electronic device for trackingly engaging said base member according to said elongated channel between said retraction profile and said extension profile.

9. The coaxial jack as recited in claim 8, wherein said base member further comprises a retraction guide within said retraction profile for maintaining said base member in said retracted position, said retraction guide including one or more sides that are adapted to receiving and retaining said flexible pin to maintain said base member in said retracted position.

10. The coaxial jack as recited in claim 9, wherein said retraction profile includes:

a) one or more sides for guiding said flexible pin to engage with said one or more sides of said retraction guide in said retracted position; and b) one or more sides for guiding said flexible pin from said retraction guide to allow said base member to traverse from said retracted position to said extended position as said flexible pin traverses from said retraction profile to said extension profile.

11. The coaxial jack as recited in claim 8, further comprising a spring for coupling between said base member and said electronic device and biased to extend said base member from said retracted position to said extended position.

12. The coaxial connector as recited in claim 8, wherein said base member further comprises an extension guide within said extension profile for maintaining said base member in said extended position, said extension guide including one or more sides that are adapted to block said flexible pin from initially passing from said extended position to said retracted position during coupling of an opposing connector with said coaxial connector of said base member.

13. The coaxial connector as recited in claim 12, wherein said extension profile includes:

a) one or more sides for guiding said flexible pin to engage with said one or more sides of said extension guide in said extended position; and b) one or more sides for guiding said flexible pin from alignment with said extension guide to allow said base member to traverse from said extended position to said retracted position as said flexible pin traverses from said extension profile to said retraction profile.

14. An electronic card comprising:

a) a housing including a top cover, a bottom cover and a boarder member the connects the top cover to the bottom cover;

b) a circuit board disposed within a compartment formed by the housing;

c) a connector slidably positioned within the compartment when in a retracted position and positioned at least partially outside said compartment when in an extended position;

d) a base member having said connector thereon, said base member movable along a portion of said boarder member between an extended position and a retracted position along an axis;

e) an elongated channel disposed within said base member, said elongated channel including:

i) a retraction profile for maintaining said base member in said retracted position; and ii) an extension profile for maintaining said base member in said extended position, said extension profile sustaining opposing force from attachment of an opposing connector to said connector on said base member; and f) a flexible pin operably coupled to said electronic device for trackingly engaging said base member according to said elongated channel between said retraction profile and said extension profile.

15. The electronic card, as recited in claim 14, wherein said connector is a coaxial plug for receiving a coaxial connector as said opposing connector.

16. The electronic card, as recited in claim 13, wherein said base member further comprises a retraction guide within said retraction profile for maintaining said base member in said retracted position, said retraction guide including one or more sides that are adapted to receiving and retaining said flexible pin to maintain said base member in said retracted position.

17. The electronic card as recited in claim 16, wherein said retraction profile includes:

a) one or more sides for guiding said flexible pin to engage with said one or more sides of said retraction guide in said retracted position; and b) one or more sides for guiding said flexible pin from said retraction guide to allow said base member to traverse from said retracted position to said extended position as said flexible pin traverses from said retraction profile to said extension profile.

18. The electronic card as recited in claim 14, further comprising a spring for coupling between said base member and said electronic device and biased to extend said base member from said retracted position to said extended position.

19. The electronic card as recited in claim 14, wherein said base member further comprises an extension guide within said extension profile for maintaining said base member in said extended position, said extension guide including one or more sides that are adapted to block said flexible pin from initially passing from said extended position to said retracted position during coupling of an opposing connector with said connector of said base member.

20. The electronic card as recited in claim 19, wherein said extension profile includes:

a) one or more sides for guiding said flexible pin to engage with said one or more sides of said extension guide in said extended position; and b) one or more sides for guiding said flexible pin from alignment with said extension guide to allow said base member to traverse from said extended position to said retracted position as said flexible pin traverses from said extension profile to said retraction profile.

* * * * *

UNITED STATES PATENT AND TRADEMARK OFFICE

CERTIFICATE OF CORRECTION

PATENT NO. : 6,579,108 B1
DATED : June 17, 2003
INVENTOR(S) : Darrell Goff

It is certified that error appears in the above-identified patent and that said Letters Patent is hereby corrected as shown below:

Column 3,
Line 21, after "is" insert -- a --
Line 42, before "media" delete "a"
Line 53, change "PCMCA" to -- PCMCIA --
Line 53, change "perimeters" to -- parameters --
Line 54, change "standard" to -- standards --
Line 57, change "combination" to -- combinations --

Column 4,
Line 46, change "finger" to -- fingers --

Column 5,
Line 12, change "is" to -- in --
Line 21, after "is" insert -- in --
Line 45, change "function" to -- functions --

Column 8,
Line 60, after "member" change "the" to -- that --

Signed and Sealed this

Twenty-sixth Day of August, 2003

JAMES E. ROGAN
*Director of the United States Patent and Trademark Office*